US006019059A

United States Patent [19]

Kelsey

[11] Patent Number: 6,019,059

[45] Date of Patent: Feb. 1, 2000

[54] OVERLAP LIFTING FIN

[76] Inventor: Kevin R Kelsey, 11538 Riviera Pl. NE., Seattle, Wash. 98125

[21] Appl. No.: 09/064,941

[22] Filed: Apr. 20, 1998

Related U.S. Application Data

[60] Provisional application No. 60/044,118, Apr. 21, 1997.

[51] Int. Cl.[7] ..... B63B 1/24

[52] U.S. Cl. ..... 114/274; 114/280; 114/39.2; 441/79

[58] Field of Search ..... 114/39.2, 274, 114/280; 441/74.75, 79

[56] References Cited

U.S. PATENT DOCUMENTS

| | | | |
|---|---|---|---|
| 594,161 | 12/1897 | Gibb | 114/121 |
| 3,324,815 | 6/1967 | Morales | 114/275 |
| 3,459,146 | 8/1969 | Prior . | |
| 3,747,138 | 7/1973 | Morgan . | |
| 4,235,397 | 11/1980 | Compton . | |
| 4,320,546 | 3/1982 | Knox | 441/74 |
| 4,508,046 | 4/1985 | Coulter et al. . | |
| 4,686,922 | 8/1987 | Burroughs | 114/124 |
| 4,715,304 | 12/1987 | Steinberg | 114/39.2 |
| 4,809,402 | 3/1989 | Rainville | 16/372 |
| 4,811,674 | 3/1989 | Stewart | 114/39.2 |
| 5,062,378 | 11/1991 | Bateman | 114/274 |
| 5,309,859 | 5/1994 | Miller | 114/274 |
| 5,463,794 | 11/1995 | Erland | 16/225 |
| 5,471,942 | 12/1995 | Miller | 114/274 |
| 5,809,926 | 9/1998 | Kelsey | 114/274 |

FOREIGN PATENT DOCUMENTS 2563177 10/1985 France .

OTHER PUBLICATIONS

Morwood, John "Hydrofoil Craft" AYRS#19, Amatuer Yacht Research Society, U.K., Jun. 1958, pp. 24–25.

Grogono, James "Icarus, The Boat that Flies" Adlard Coles Ltd, London, 1987, pp. 111–112.

"Now Your Sailboard Can Fly" Popular Mechanics Magazine, Jun. 1983, pp. 72–74.

Garrett, R "Sulu–Mosquito Trimaran MkII" Letters in book by Amatuer Yacht Research Society Members, "Sailing Hydrofoils" AYRS #74, Hermitage–Berks, 1970, pp. 197–202.

*Primary Examiner*—Jesus D. Sotelo

[57] ABSTRACT

A sloped hydrofoil (22) is mounted to the bottom of a sailboard or surfboard vertical strut (26) using a hinge joint (24). Hinge joint (24) allows reversal of the slope of sloped hydrofoil (22) in response to a hull (30) side slip. Efficient sloped hydrofoil (22) supports a portion of craft weight to reduce hull (30) drag.

20 Claims, 8 Drawing Sheets

FIG 4A
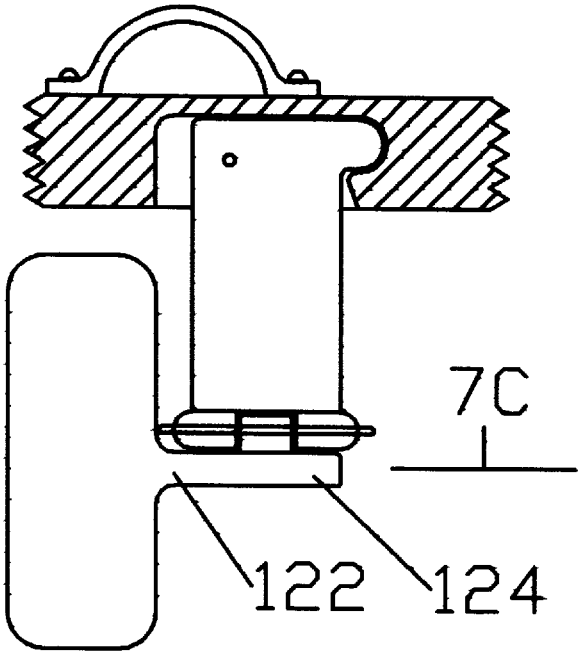
FIG 4B
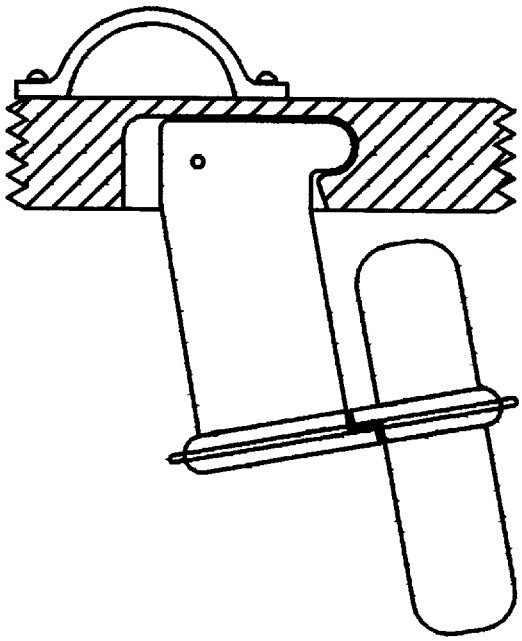
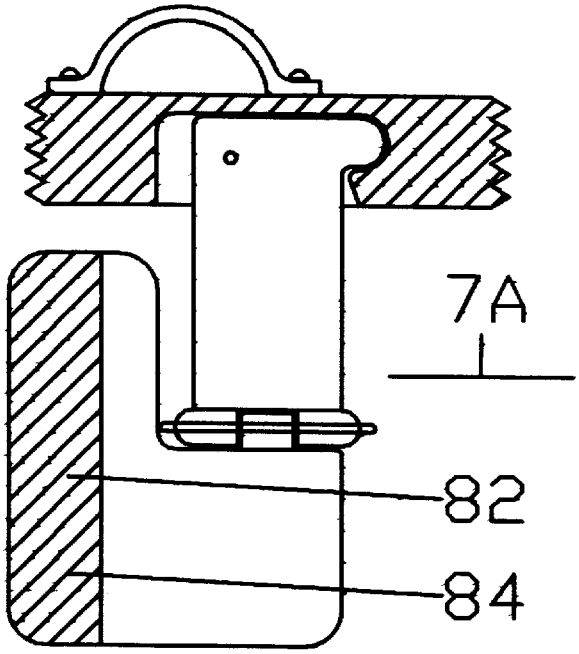
FIG 4C
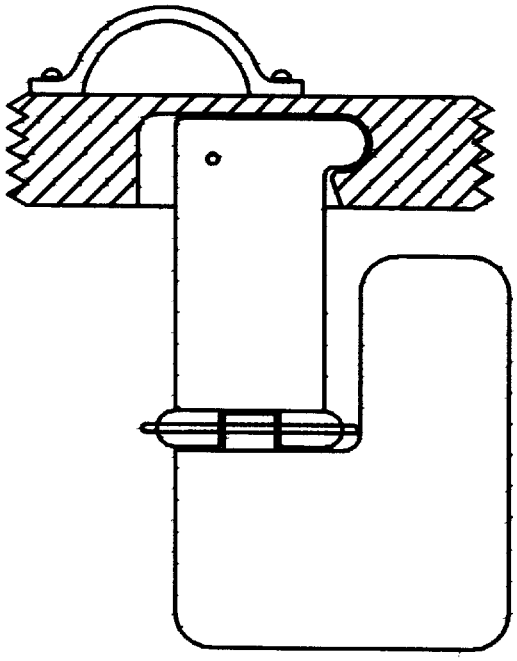
FIG 4D

OVERLAP LIFTING FIN

CROSS-REFERENCE TO RELATED APPLICATIONS

This application claims the benefit of U.S. Provisional Application No. 60/044,118, filed Apr. 21, 1997. This application is related to U.S. application Ser. No. 08/501,414 filed Jul. 12, 1995, now U.S. Pat. No. 5,809,926.

BACKGROUND-FIELD OF INVENTION

This invention relates to sailboats, to sailboards, to surfboards, and to hydrofoil arrangements which can be used to improve the efficiency and speed.

BACKGROUND-DESCRIPTION OF PRIOR ART

Nearly all prior art for hydrofoil equipped sailboats, sailboards and surtboards have sought to raise the hull from the water. This approach suffers a number of disadvantages:

(a) Close proximity of the hydrofoil to the waters surface and piercing of the waters surface increases the occurrence of ventilation.

(b) Close proximity of the hydrofoil to the waters surface reduces the efficiency of the hydrofoil.

(c) The number of hydrofoil elements required for pitch and roll stability once the hull is removed from the water increases the complexity of the design.

U.S. Pat. No. 4,811,674 to Stewart (1989) utilized hydrofoils to provide lift without raising a sailboard hull from the water. The hydrofoil elements were attached to the rail of the hull and were vulnerable to ventilation and low efficiency due to surface proximity. The hydrofoils required custom attachment points on the hull or used two thruster finbox present only on a specialized wave riding sailboard hull or specialized surfboard.

U.S. Pat. No. 08/501,414 to the applicant titled LIFTING FIN disclosed a hydrofoil fin of small area for high speed sailing, not optimized for large hydrofoil areas required for light wind sailing.

OBJECTS AND ADVANTAGES

Several objects of the overlap lifting fin are:

(a) simplicity of hydrofoil configuration by using only a single unit;

(b) reduce ventilation of the hydrofoil by deep submergence;

(c) give excellent rough water stability by using a hull in contact with the water, (d) provide a large magnitude of lift to allow planing in light winds Taken together, the above objects lead to the prime object to increase sailboat, sailboard and surfboard speed.

Still further objects and advantages will become apparent from a consideration of the ensuing description and drawings.

DRAWING FIGURES

FIG. 4A shows a side view of a sailboard or surfboard hull with an alternate embodiment of the hinge joint moved underneath the bottom of the vertical strut, with the sloped hydrofoil extending forward to a hinge joint.

FIG. 4B shows a side view of a sailboard or surfboard hull with an alternate embodiment of the overlap lifting fin with the sloped hydrofoil mounted forward of the vertical strut.

FIG. 4C shows a side view of a sailboard or surfboard hull with an alternate embodiment of the overlap lifting fin with the sloped hydrofoil located rearward and underneath the bottom of the vertical strut.

FIG. 4D shows a side view of a sailboard or surfboard hull with an alternate embodiment of the overlap lifting fin with the sloped hydrofoil located forward and underneath the bottom of the vertical strut.

REFERENCE NUMERALS IN DRAWINGS

Figure 1A:
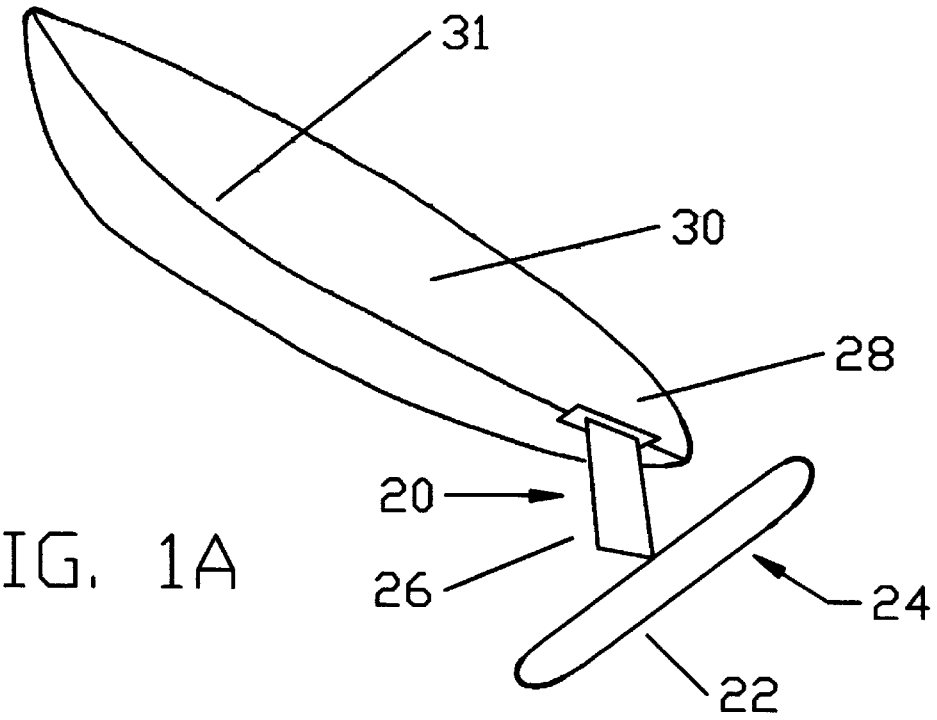
FIG. 1A shows a perspective view of the bottom of a sailboard or surfboard hull with an overlap lifting fin.

20 overlap lifting fin
22 sloped hydrofoil
24 hinge joint
26 vertical strut
28 standard fin box
30 standard slalom style sailboard or surfboard hull
31 fore and aft centerline on hull
32 hinge bulb on sloped hydrofoil
34 hinge bulb on vertical strut
36 hinge pin
46 hinge stop
50 standard sailboard retracting centerboard
60 foot strap
70 overlap lifting fin dagger board
72 conventional dinghy hull
74 hull recess
76 hold-down line
78 retraction line
82 flexible hinge
84 layer of rubber
90 threaded rod
92 dowel nut
98 lever

104 angle to water flow
106 composite laminate
108 hinge pin bushing
110 custom fibers in composite laminate
112 angular projection hinge stop from hinge bulb on sloped hydrofoil
114 angular projection hinge stop from hinge bulb on vertical strut
120 hinge stop
122 flexible hinge
124 stub Description—FIGS. 1 to 8

Figure 1B:
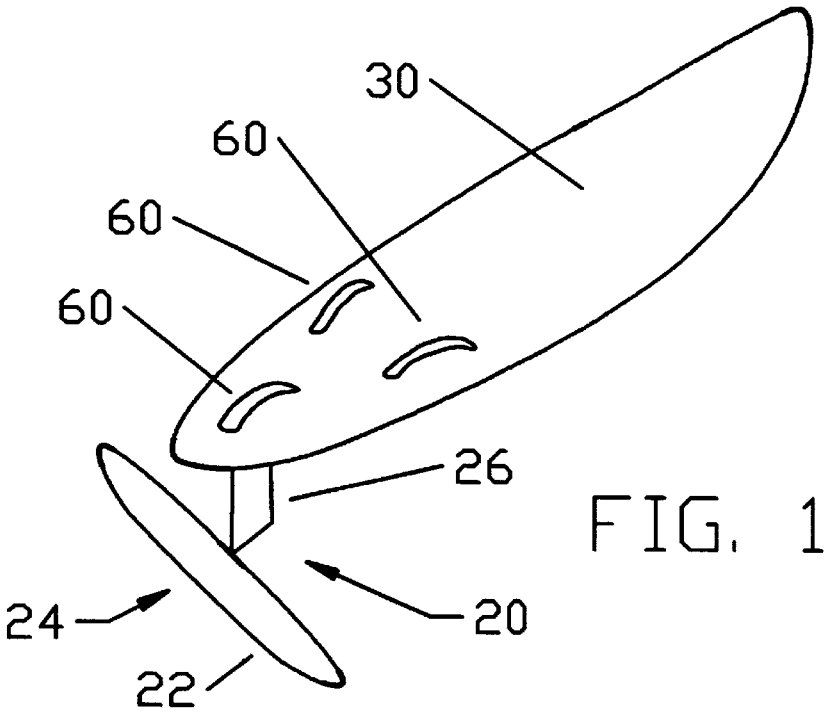
FIG. 1B shows a perspective view of the top of a sailboard or surfboard hull with an overlap lifting fin.

In FIGS. 1A and 1B, a standard slalom style sailboard or surfboard hull 30 has a standard box 28 and a trio of foot strap 60. Hull 30 has a fore and aft centerline 31 substantially parallel to the water flow. A overlap lifting fin 20 has a vertical strut 26 which is inserted into finbox 28. At the bottom end of vertical strut 26 is a hinge joint 24 which connects to a sloped hydrofoil 22. Hinge joint 24 allows sloped hydrofoil 22 to freely swing side-to-side relative to vertical strut 26.

Figure 2:
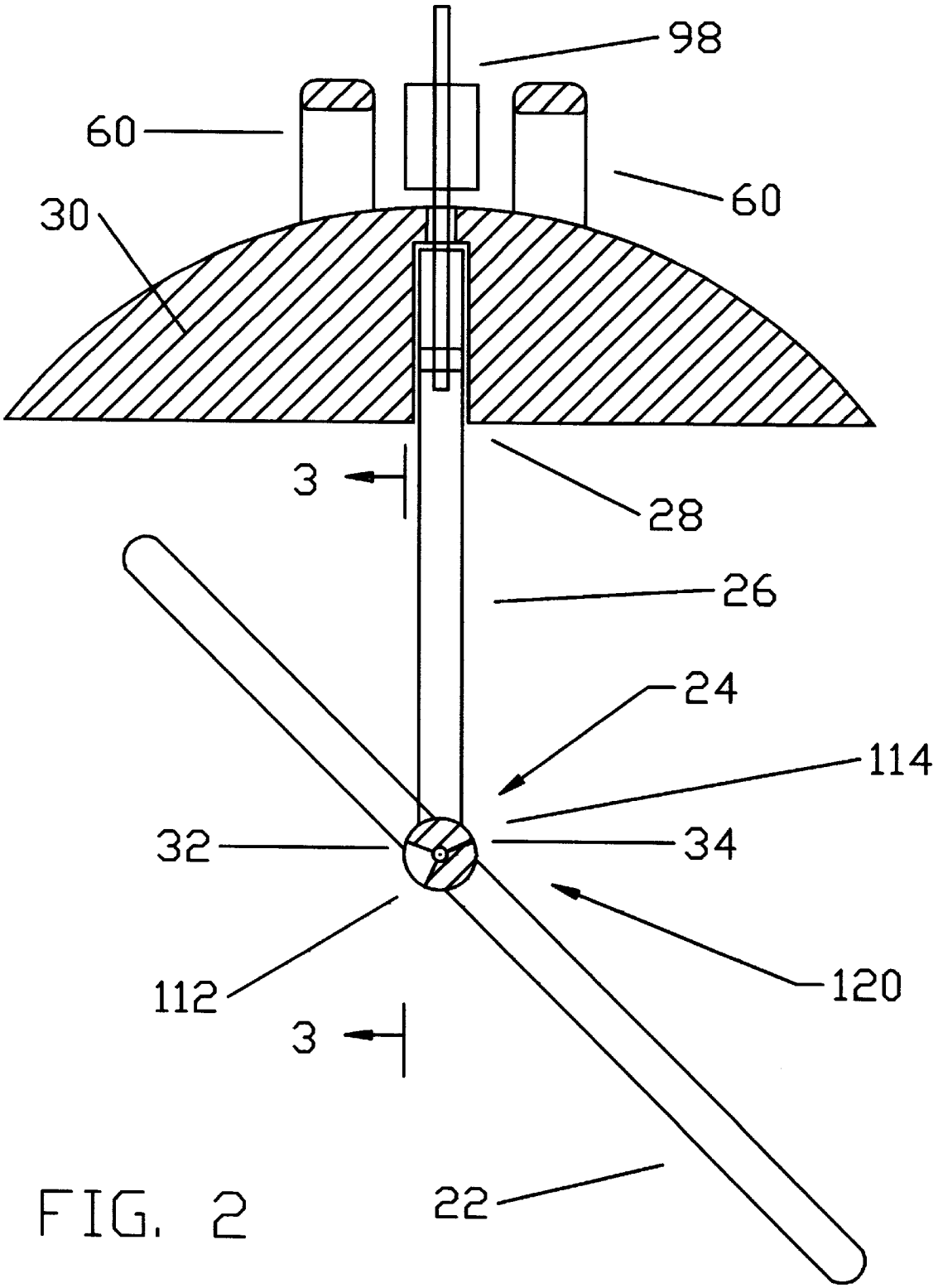
FIG. 2 shows an end view of a sailboard or surfboard hull with an overlap lifting fin.
Figure 3:
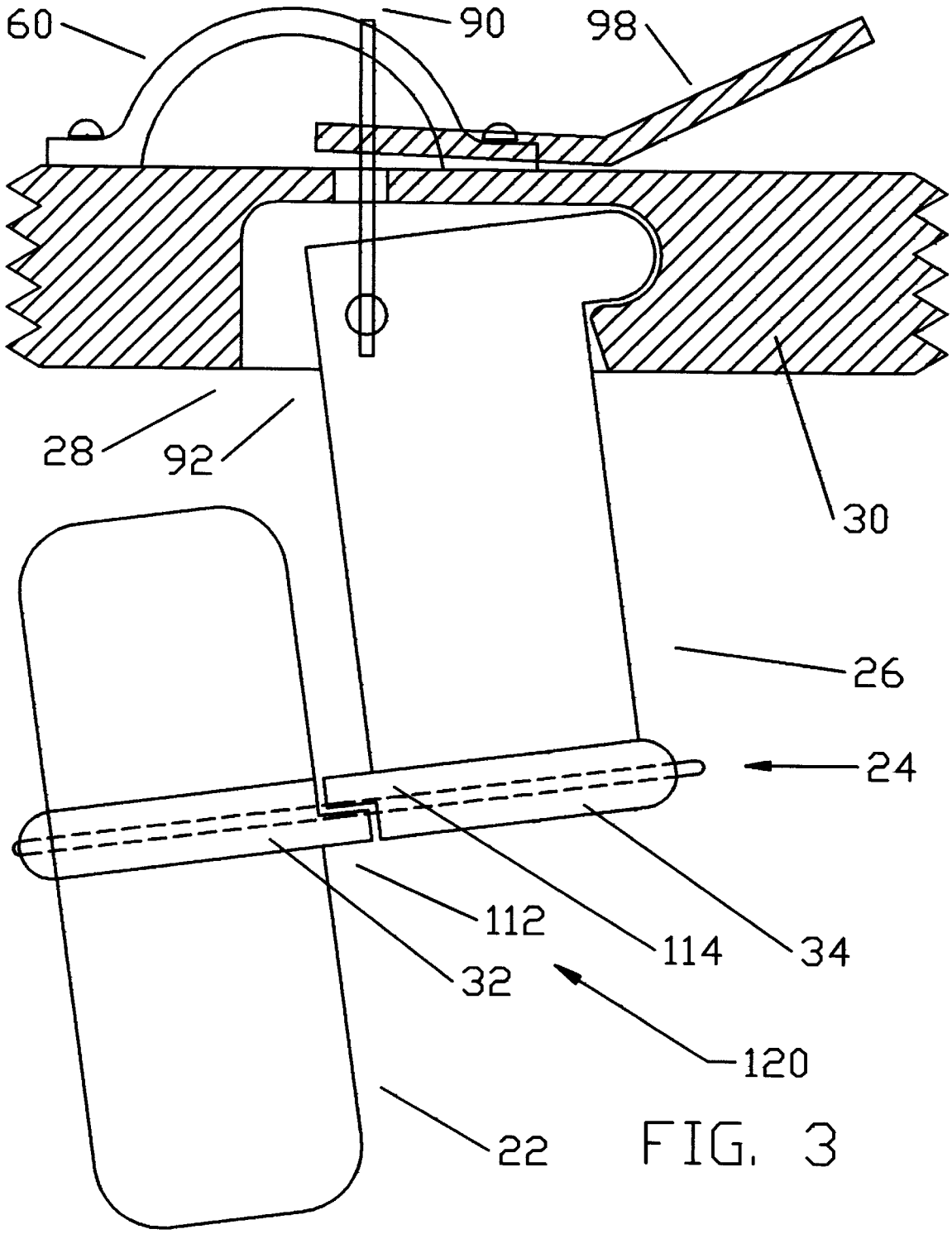
FIG. 3 shows a side view of a sailboard or surfboard hull with an overlap lifting fin.

FIGS. 2 and 3 show end and side view of hull 30 and overlap lifting fin 20.

Hull 30 is a typical surfboard or sailboard hull with a top surface deck, a bottom surface and rails that forms the perimeter of hull 30. Hull 30 also has a rearward end, a forward end and windward and leeward sides. Hull 30 is a planing hull that generates a planing force and has a planing trim angle to the water flow.

Hull 30 also contains a recess, finbox 28, located closely adjacent to the rearward end of hull 30 and is aligned with fore and aft centerline 31. Finbox 28 has front and back ends and windward and leeward sides.

Finbox 28 is a joint between the upper end of vertical strut 26 and hull 30. Vertical strut 26 is a substantially vertical hydrofoil with a hydrofoil cross-section and an angle to the water flow such that it generates hydrodynamic forces. Vertical strut 26 has an upper end, a bottom end, windward and leeward sides, and a forward and rearward edge. Vertical strut 26 is aligned substantially parallel to fore and aft centerline 31.

At the bottom end of vertical strut 26 is hinge joint 24. Hinge joint 24 joins the sloped hydrofoil 22 to the bottom end of vertical strut 26. Hinge joint 24 allows sloped hydrofoil 22 to freely swing side-to-side relative to vertical strut 26. Hinge joint 24 is formed of a hinge bulb 34 on the bottom end of vertical strut 26, a hinge bulb 32 on sloped hydrofoil 22, and a hinge pin 36. A hole is drilled through hinge bulb 32 and 34 for hinge pin 36. Hinge pin 36 forms the hinging axis of hinge joint 24 which is aligned substantially parallel to fore and aft centerline 31. Also part of hinge joint 24 is a hinge stop 120 which is a means for limiting the angular movement about the hinge pivot axis.

Sloped hydrofoil 22 has a hydrofoil cross-section and an angle to the water flow such that it generates hydrodynamic forces. Sloped hydrofoil 22 has an upper wingtip, a bottom wingtip, windward and leeward sides, a forward edge, a rearward edge, and a span between the wingtips. Sloped hydrofoil 22 is aligned substantially parallel to fore and aft centerline 31. Sloped hydrofoil 22 can be free to swing up to 90 degrees on either side of the vertical before the angular motion is arrested by hinge stop 120.

Overlap lifting fin 20 can be typically constructed of fiberglass and/or metal.

In FIG. 2, the bottom wingtip of sloped hydrofoil 22 is lower than hinge joint 24 and the upper wingtip of sloped hydrofoil 22 is higher than hinge joint 24. Sloped hydrofoil 22 is also completely rearward of the rearward edge of vertical strut 26.

A point on sloped hydrofoil 22 is a theoretical geometric center of all forces on sloped hydrofoil 22. The hinging axis of hinge joint 26 needs to vertically higher than the center of all forces in order for sloped hydrofoil 22 to automatically slope in the intended direction under the influence of sideslip. Sloped hydrofoil 22 is intended to slope with the bottom wingtip to windward and the upper wingtip to leeward under the influence of sideslip. The span length of sloped hydrofoil 22 is limited by the need for the upper wingtip of sloped hydrofoil 22 to rotate above hinge joint 24 without hitting the bottom of hull 30.

Hinge joint 24 is connected to sloped hydrofoil 22 at an asymmetric span position to insure the hinging axis remains above the center of the geometric center of all forces on sloped hydrofoil 22. The asymmetric span position is a point, located on the span of sloped hydrofoil 22, closer to the upper wingtip of sloped hydrofoil 22 than the center of hydrodynamic forces.

FIGS. 2 and 3 show the details of hinge stop 120 an angular projection 112 from hinge bulb 32 and an opposite angular projection 114 from hinge bulb 34. When the side faces of the two projections are in contact with each other, the rotation of hinge joint 22 is stopped. The angular projections 112 and 114 can be cast or molded as part of hinge bulb 32 and 34.

FIG. 3 also shows a side view of hull 30 and an embodiment that allows manual adjustment of sloped hydrofoil 22 angle to the water flow. The upper end of vertical strut 26 is able to pivot within fin box 28 by way of a pivoting mechanism. The pivoting action of vertical strut 26 within fin box 28 has a hinging axis that is horizontally perpendicular to fore and aft centerline 31. A threaded rod 90 connects to a dowel nut 92 in vertical strut 26 and passes through a bolt hole that is part of fin box 28. Lever 98 has a front end and a back end and a pivot point that is substantially perpendicular to fore and aft centerline 31. When the crew steps down on the front end of lever 98, vertical strut 26 is pulled tight into fin box 28. Vertical strut 26 then has no rake and sloped hydrofoil 22 has a minimum angle to the water flow. When the crew steps down on the back end of lever 98, vertical strut 26 is pushed down in fin box 28. Vertical strut 26 then has maximum rake and sloped hydrofoil 22 has a maximum angle to the water flow. The maximum rake allowed is set by the contact of lever 98 against the deck of hull 30. Thus the crew can manually change the rake of vertical strut 26 and sloped hydrofoil 22 angle to the water flow by stepping down on lever 98.

FIG. 4A shows a side view of hull 30 with an alternate embodiment of overlap lifting fin 20 with sloped hydrofoil 22 extending forward to an alternate embodiment of hinge joint 24 on the bottom of the vertical strut 26. In this embodiment, hinge bulb 32 on sloped hydrofoil 22 forms a tendon and hinge bulb 34 on vertical strut 26 has a notch for the tendon. Also in this embodiment, a hinge stop 120 is a projection from hinge bulb 32, the tendon inside to the notch, that hits against vertical strut 26 above the notch. Also a flexible hinge 122 between a stub 124 and sloped hydrofoil 22 bends under the hydrodynamic forces of sloped hydrofoil 22.

FIG. 4B shows a side view of hull 30 with an alternate embodiment of overlap lifting fin 20 with sloped hydrofoil 22 mounted forward of vertical strut 26.

FIG. 4C shows a side view of hull 30 with an alternate embodiment of overlap lifting fin 20 with sloped hydrofoil 22 located rearward and underneath the bottom of vertical strut 26. Also a flexible layer of rubber 84 covers a flexible hinge 82 that comprises the rearward portion of sloped hydrofoil 22 that bends under the hydrodynamic forces of sloped hydrofoil 22.

FIG. 4D shows a side view of hull 30 with an alternate embodiment of overlap lifting fin 20 with sloped hydrofoil 22 located forward and underneath the bottom of vertical strut 26.

Figure 5A:
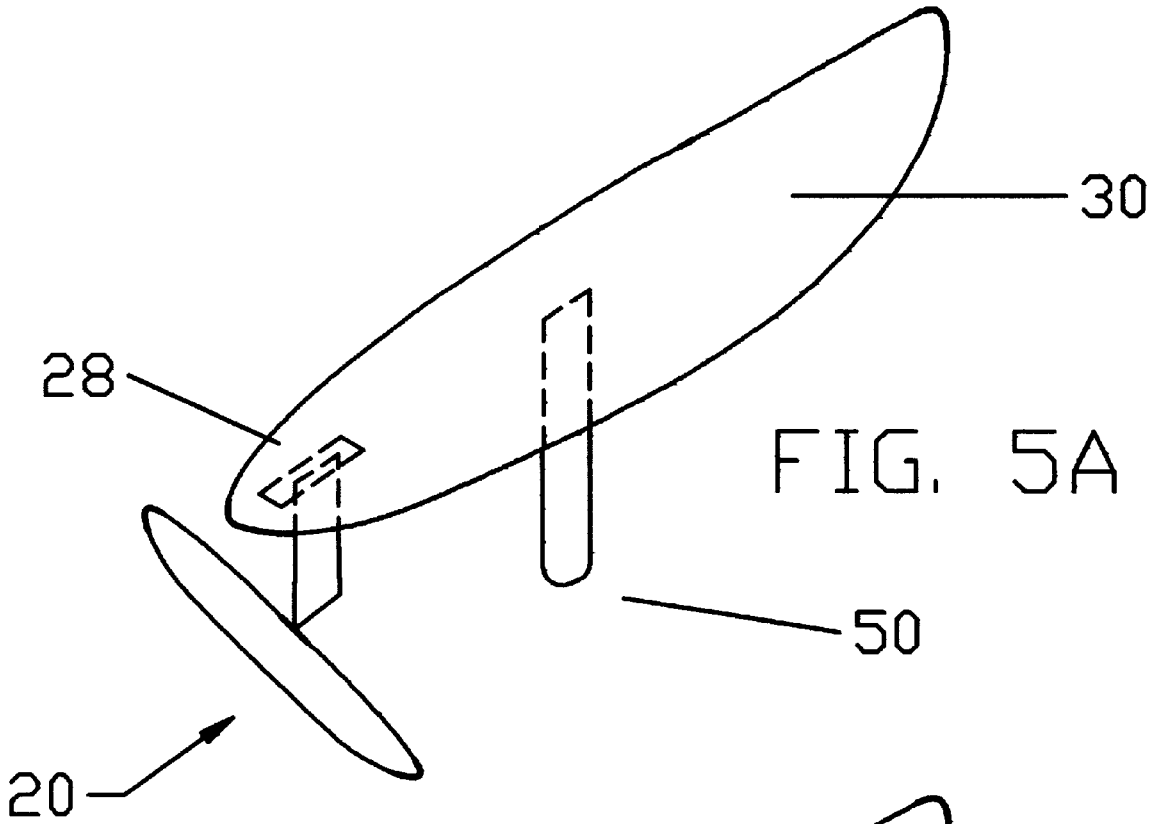
FIG. 5A shows a perspective view of a sailboard hull with an overlap lifting fin and a standard retracting centerboard.

In FIG. 5A, hull 30 has finbox 28 and overlap lifting fin 20 and a standard sailboard retracting centerboard 50. Centerboard 50 is located in the standard position on hull 30.

Figure 5B:
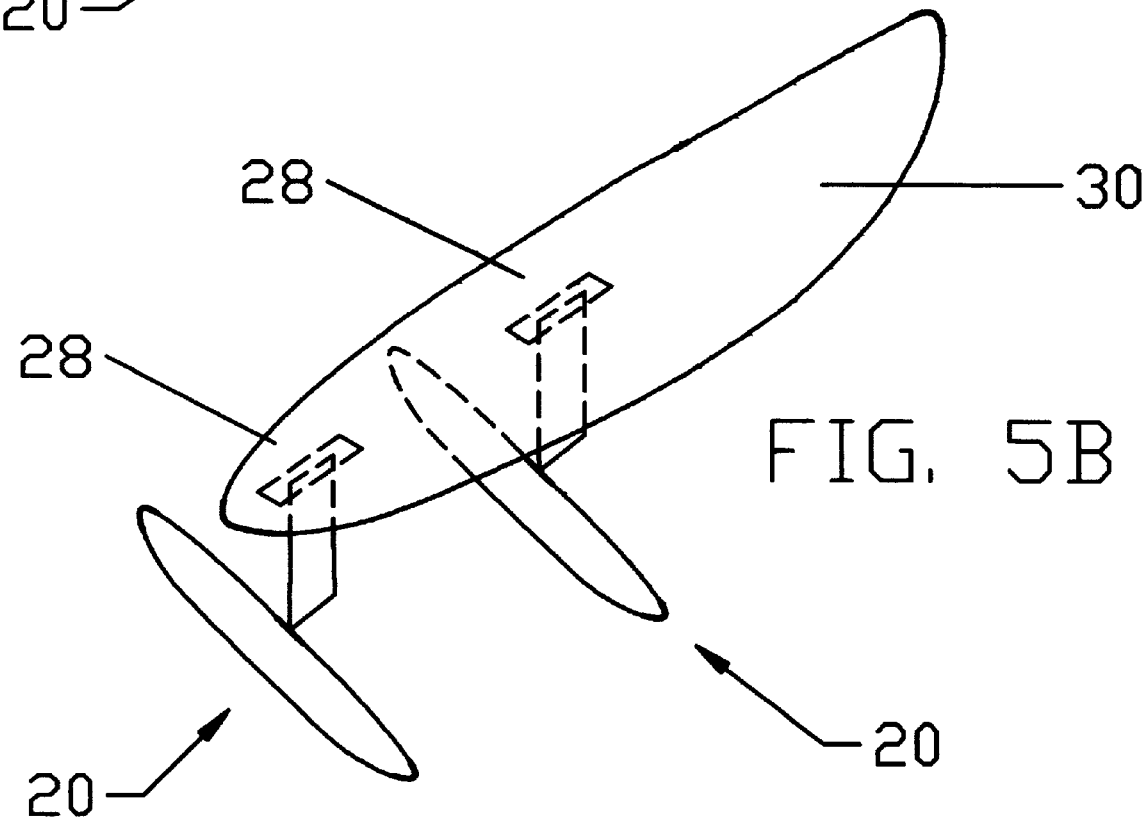
FIG. 5B shows a perspective view of a sailboard hull with two overlap lifting fin spaced fore and aft.

In FIG. 5B, hull 30 has two finbox 28 and two overlap lifting fin 20 mounted fore and aft on fore and aft centerline 31.

Figure 6:
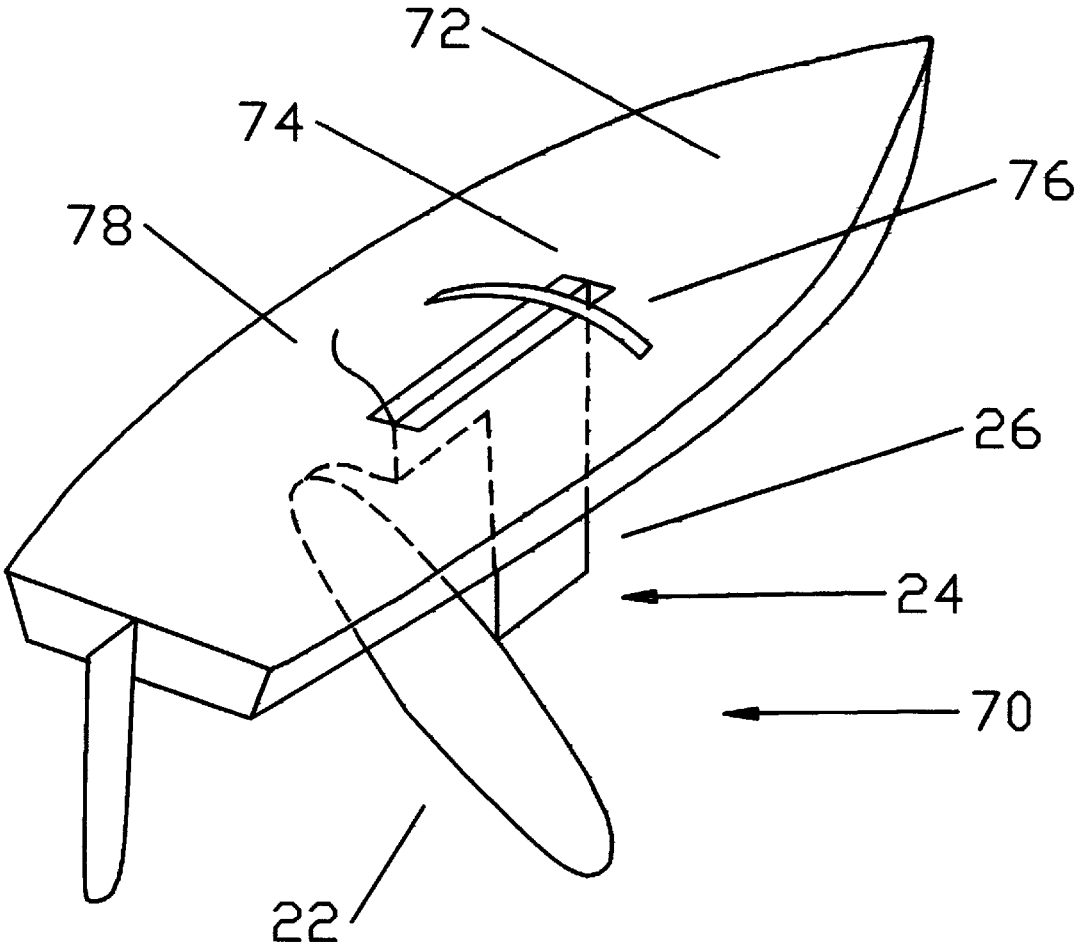
FIG. 6 shows a perspective view of a standard dinghy hull with an overlap lifting fin dagger board.

FIG. 6 shows an alternate embodiment with a overlap lifting fin dagger board 70 retrofit to a conventional dinghy hull 72. Hinge joint 24 can be made small enough, with the much larger size of a dagger board, to be retracted up into a recess 74 in the bottom of dinghy hull 72. Recess 74 can be a standard centerboard or dagger board trunk. A retraction line 78, attached to the upper wingtip of sloped hydrofoil 22 and up through hull recess 74, pulls sloped hydrofoil 22 into a vertical position to allow it to be retracted up into hull recess 74. Retraction line 78 can also be used as a hinge stop, limiting the rotation of sloped hydrofoil 22 from the vertical. A hold-down line 76 is used to hold overlap lifting fin dagger board 70 from rising in hull recess 74.

Figure 7A:
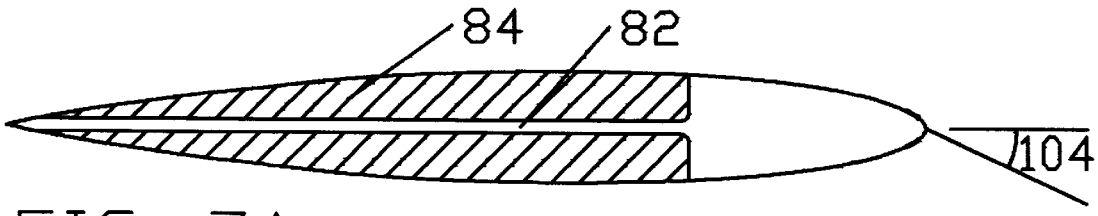
FIG. 7A shows a cross section of a flexible hinge on the sloped hydrofoil.
Figure 7B:
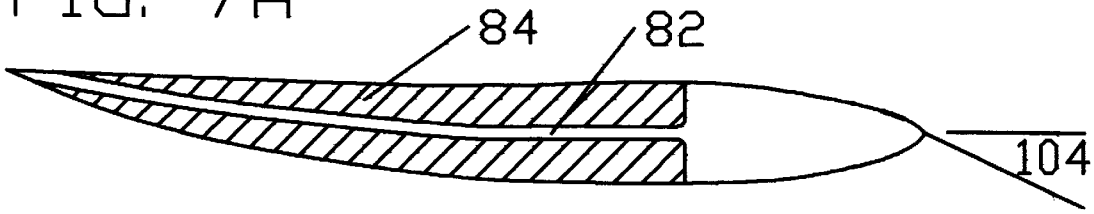
FIG. 7B shows a cross section of a flexible hinge in the bent position.

FIG. 7A shows a cross-section of sloped hydrofoil 22 with flexible hinge 82, and rubber 84 as disclosed in FIG. 4C. Sloped hydrofoil 22 has an angle to water flow 104. FIG. 7B shows the cross-section with flexible hinge 82 in a bent position. Flexible hinge 82 deflects under hydrodynamic forces to reduce angle to water flow 104 of the rearward edge of sloped hydrofoil 22.

Figure 7C:
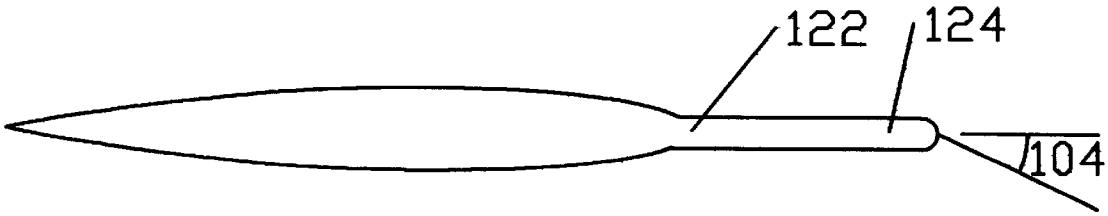
FIG. 7C shows an alternate cross section of a flexible hinge on a stub ahead of the sloped hydrofoil.

FIG. 7C shows a cross-section with flexible hinge 122 on stub 124 ahead of the forward edge of sloped hydrofoil 22 as disclosed in FIG. 4A.

Figure 7D:
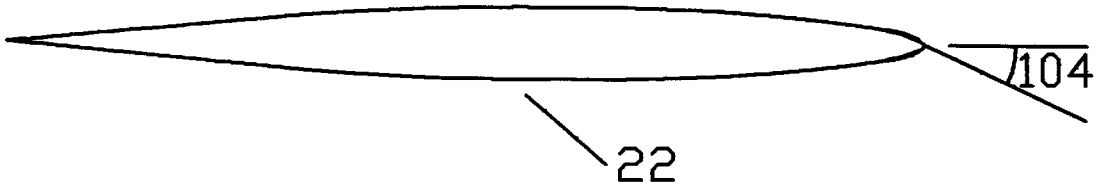
FIG. 7D shows a cross section of a thin flexible foil used on the sloped hydrofoil.

FIG. 7D shows a cross section of sloped hydrofoil 22 that is very thin and flexible and bends similar to flexible hinge 82. The thin cross section can be constructed with unidirectional materials that allows a stiff forward edge but a cross-section that bends.

FIGS. 8A, 8B, 8C and 8D show an alternative method of construction that allows a strong one piece construction of hinge joint 24, hinge bulbs 32 and 34 integral to the construction of vertical strut 26 and sloped hydrofoil 22. The method utilizes a composite laminate 106 that is folded around a hinge pin bushing 108 and then back onto itself Composite laminate 106 is typically formed of fiberglass or carbon fibers bonded together by epoxy resin.

Figure 8A:
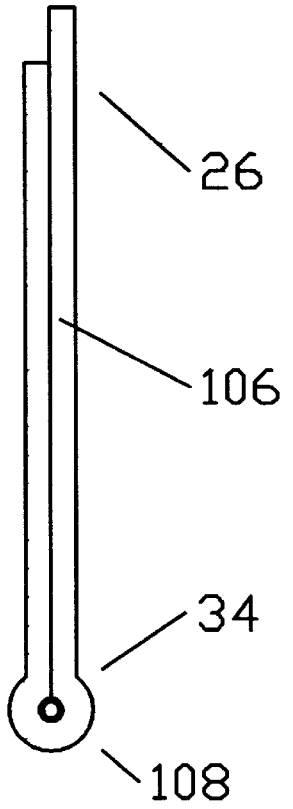
FIG. 8A shows a composite laminate construction around a hinge pin bushing.
Figure 8B:
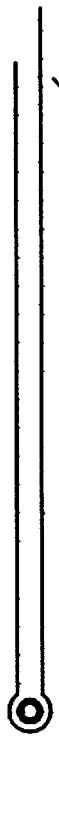
FIG. 8B shows a plurality of custom fibers within the composite laminate.

FIGS. 8A and 8B show an end view of vertical strut 26 with the alternative method of construction using composite laminate 106. The construction method orients a plurality of custom fibers 110 folding around one side of hinge pin bushing 108 so they resists hinge pin bushing 108 from tearing out the bottom end of vertical strut 26. Custom fibers 110 can be typically of composite tape, fabric or filament.

In FIG. 8B, custom fibers 110 in vertical strut 26 have an origin at the upper end of vertical strut 26, run down and fold around the bottom end of vertical strut 26 and hinge pin bushing 108 and then run back up to the upper end of vertical strut 26 and end. The origin and endpoints of custom fibers 110 are adjacent to each other and are bonded together by the resin. Custom fibers 110 form a loop around hinge pin bushing 108 and hinge pin 36. The loops are formed integrally to vertical strut 26. Hinge bulb 34 is partially formed by custom fibers 110 that loop around hinge pin bushing 108.

Many other fibers in vertical strut 26 of composite laminate 106 run in other directions to hold composite laminate 106 together. Hinge pin bushing 108 is typically a hollow tube with an inside diameter closely fitting hinge pin 36. Bushing 108 can be typically made of composite laminate or a metal tube. Alternately, bushing 108 can consist of hinge pin 36 which is left embedded in the wrap of custom fibers 110 or driven out after composite laminate 106 is cured.

The construction method is accomplished before the curing of composite laminate 106 resin by use of pre-preg laminates with oven cured resins or by quick work using a room temperature slow cure resin.

Figure 8C:
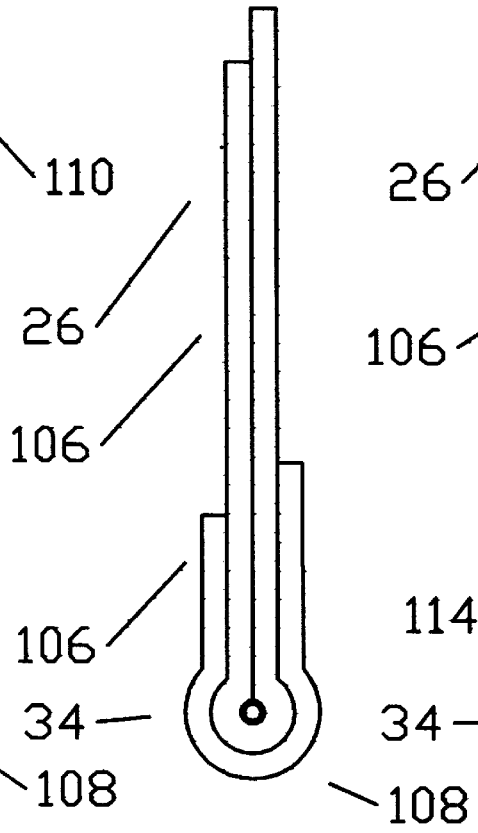
FIG. 8C shows an additional layer of composite laminate fold.

In FIG. 8C, additional layers of composite laminate 106 can be folded around hinge pin bushing 108 for greater strength.

Figure 8D:
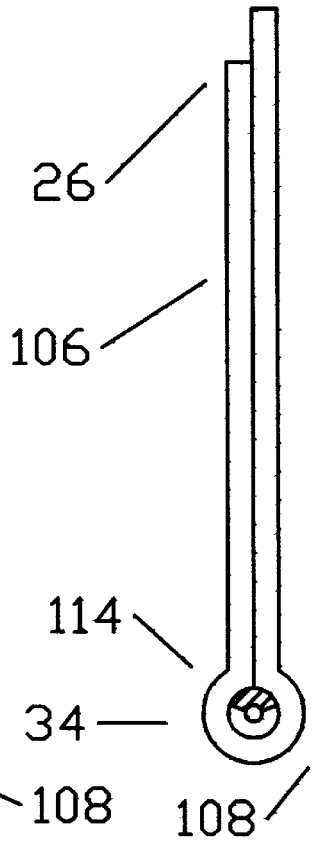
FIG. 8D shows a vertical strut with composite laminate construction.

FIG. 8D shows the construction of vertical strut 26 with hinge bushing 108 modified to form hinge stop 120. Hinge bushing has a large wall thickness that is shaped to form angular projection hinge stop 114.

Figure 8E:
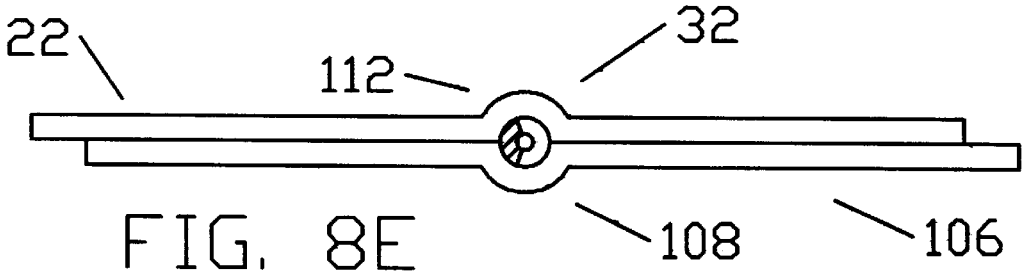
FIG. 8E shows a sloped hydrofoil with composite laminate construction.

FIG. 8E shows the construction of sloped hydrofoil 22 with hinge bushing 108 modified to form hinge stop 120. Hinge bushing 108 has a large wall thickness that is shaped to form angular projection hinge stop 112. The origin and endpoints of custom fibers 110 are at either wingtip of sloped hydrofoil 22 and custom fibers 110 would lie adjacent to hinge pin bushing 108 forming hinge bulb 32 on sloped hydrofoil 22.

Operation—FIGS. 1 to 8

FIGS. 1A and 1B shows slalom style sailboard or conventional surfboard hull 30 with a single overlap lifting fin 20 providing all directional stability and side force generation. The sideslip of hull 30 when propelled by a sail (not shown), or sliding down a wave, causes the bottom wingtip of sloped hydrofoil 22 to swing to windward, or upward to the crest of the wave. Vertical strut 26 then generates side force and sloped hydrofoil 22 then generates both side force and upward lift.

The bottom wingtip of sloped hydrofoil 22 extends to windward as side slip creates angle to the water flow and hydrodynamic forces. Sloped hydrofoil 22 creates upward lift to lift hull 30 onto a plane. Hull 30 remains in contact with the water to provide stability and control for overlap lifting fin 20. The contact of hull 30 with the water also reduces the ventilation of vertical strut 26.

When the sailor or sailboarder tacks or jibes, the new sideslip direction swings sloped hydrofoil 22 to the opposite side. When the surfboarder cuts back to reverse direction, the new sideslip direction also swings sloped hydrofoil 22 to the opposite side.

FIGS. 2 and 3 show hinge stop 120 which limits the swing of hinge joint 24. In practice, an angle from vertical of 45 degrees has given best performance. The angle to the water flow of sloped hydrofoil 22 is set by a combination of hull side slip and hull pitch trim. Sloped hydrofoil 22 swings about hinge joint 24 to a vertical position underneath hull 30 and to a mirror opposite position under the influence of hull 30 sideslip.

FIG. 4A shows the preferred location of sloped hydrofoil 22 rearward of vertical strut 26. The center of lift of sloped hydrofoil 22 is rearward of stub 124 and thus creates a large bending moment on flexible hinge 122. Stub 124 is constructed of a flexible material that bends where it attaches to sloped hydrofoil 22 to form flexible hinge 122. The span wise roll moment on flexible hinge 122 is low due to the near span wise symmetry of sloped hydrofoil 22. FIG. 7C shows a cross section of sloped hydrofoil 22 and foil stub 124.

The alternate embodiments of FIGS. 4B, 4C and 4D allow adjustment of the position of forces generated by sloped hydrofoil 22 and allow added sloped hydrofoil 22 area for a given span length.

FIG. 5 adds centerboard 50 to increase side slip resistance in light winds. This improves windward performance in light wind and centerboard 50 can be retracted in strong wind when no longer required.

FIG. 5 shows an alternate embodiment with two overlap lifting fin 20 mounted on hull 30. Forward finbox 28 is mounted at the standard location of centerboard 50. The forward overlap lifting fin 20 gives upward lift and sideslip resistance instead of just the sideslip resistance of centerboard 50 to increase the ability to plane in light wind. This configuration allows use of two smaller overlap lifting fin 20 rather than a very large area overlap lifting fin 20 for light wind planing.

FIG. 6 shows a retracting overlap lifting fin 20. Retraction line 78 is pulled by the crew to bring sloped hydrofoil 22 in vertical alignment with vertical strut 26 so sloped hydrofoil 22 and vertical strut 26 can be pulled up into hull recess 74.

FIGS. 7A and 7B, show flexible hinge 82 which can automatically adjust the hydrodynamic forces of sloped hydrofoil 22. As the speed of the board increases, the hydrodynamic forces of sloped hydrofoil 22 increase and increase the bend of flexible hinge 82. The bend of flexible hinge 82 decreases angle to the water flow 104 of the rearward edge and reduces the increase in hydrodynamic forces.

FIGS. 7C show another flexible hinge 122 which also can automatically adjust sloped hydrofoil 22 lift. Flexible hinge 122 is positioned ahead of sloped hydrofoil 22 and uses the alternate embodiment of sloped hydrofoil 22 shown in FIG. 4A.

FIGS. 2 and 3 also show an embodiment with lever 98 that allows manual adjustment of sloped hydrofoil 22 angle to the water flow 104. The crew can manually make the change by stepping down on lever 98 on the deck of hull 30. The crew can step down on lever 98 while sailing.

The adjustment of foil trim made by automatic flexible hinge, flexible foil, and /or manual lever action has a significant impact on sailing performance. High angle to the water flow 104 of sloped hydrofoil 22 greatly increases the ability of hull 30 to plane in light winds. Low angle to the water flow 104 of sloped hydrofoil 22 reduces the drag of sloped hydrofoil 22 and improves the control of hull 30 in strong winds.

Summary, Ramifications, and Scope

Overlap lifting fin 20 design in FIGS. 1A and 1B is very simple and practical. Overlap lifting fin 20 is quick and easy to mount and detach as it is small in size and it is a single unit. It is no more inconvenient to mount than the standard fin (not shown) it replaces. Quick mounting allows interchange of hydrofoil sizes or use of a standard fin (not shown) to suit the changing sailing or surfing conditions for maximum performance.

Overlap lifting fin 20 reduces ventilation and maximizes hydrofoil efficiency by deep submergence of sloped hydrofoil 22 by its attachment to the bottom of vertical strut 26.

Overlap lifting fin 20 gives excellent rough water stability by taking advantage of hull 30 excellent rough water stability by maintaining hull 30 contact with the water.

Overlap lifting fin 20 reduces hull 30 drag. The vertical dynamic lift of the deeply submerged sloped hydrofoil 22 has a higher lift to drag ratio than planing lift of hull 30. Sloped hydrofoil 22 vertical lift reduces required hull 30 planing lift and thus reduces hull 30 drag.

Overlap lifting fin 20 provides a very large lifting sloped hydrofoil 22 to lift hull 30 onto a plane in very light winds.

As a result of the advantages above, sailboat, sailboard and surfboard speed is increased.

Overlap lifting fin 20 using the automatic and/or the manual adjustment of sloped hydrofoil 22 angle to the water flow of flexible hinge 82, or flexible hinge 122, and/or lever 98 gives hull 30 a very wide speed range of high performance. Using very high angle to the water flow greatly improves low speed planing ability while the automatic and/or manual reduction of the high angle to the water flow allows excellent top end speed. The excellent top end and low speeds are both achieved with the same equipment without the need to stop sailing to make adjustments.

The vertical lift of overlap lifting fin 20 reduces the water speed required for planing, thus adding low speed performance to a given size of hull 30. The optimum wind speed range, or surfing wave size, for a given hull 30 design is thus extended by use of overlap lifting fin 20. This makes a single hull 30 more versatile, eliminating the need for a second hull 30 size to cover the lower speed range.

The lower planing speed makes it easier for the crew to pump the sail (not shown) in order to propel hull 30 onto a plane.

Although the description above contains many specificities, these should not be construed as limiting the scope of the invention, but as merely providing illustrations of some of the presently preferred embodiments of this invention. Thus the scope of the invention should be determined by the appended claims and their legal equivalents, rather than by the examples given.

I claim:

1. A hydrofoil assembly mounted on a hull, having a fore and aft centerline, comprising:

(a) a substantially vertical strut, having a bottom end, an upper end, and a rearward edge;

(b) a sloped hydrofoil, having a bottom wingtip and an upper wingtip;

(c) a hydrofoil hinging means, having a hinging axis, joining said vertical strut to said sloped hydrofoil, the hinging axis of said hinging means substantially parallel to the fore and aft centerline of said hull;

(d) said sloped hydrofoil located with the bottom wingtip of said sloped hydrofoil lower than the hinging axis of said hinging means, and the upper wingtip of said sloped hydrofoil higher than the hinging axis of said hinging means;

(e) said hydrofoil hinging means, having a range of hinging motion, so that the upper wingtip of said sloped hydrofoil remains above the hinging axis of said hinging means for all range of hinging motion, and the bottom wingtip of said sloped hydrofoil remains lower than the hinging axis of said hinging means for all range of hinging motion.

2. The hydrofoil assembly mounted on a hull, having a fore and aft centerline, of claim 1 further including the upper wingtip of said sloped hydrofoil located completely rearward of the rearward edge of said vertical strut for all range of hinging motion.

3. The hydrofoil assembly mounted on a hull, having a fore and aft centerline, of claim 1 further including:

(a) a hull in contact with the water, having a bottom;

(b) a hull attachment means for mounting the upper end of said vertical strut to the bottom of said hull.

4. The hydrofoil assembly mounted on a hull, having a fore and aft centerline, of claim 1 further including:

(a) a hull, having a bottom;

(b) a first hull attachment means for mounting the upper end of said vertical strut to the bottom of said hull;

(c) a second substantially vertical strut, having an upper end;

(d) a second hull attachment means for mounting the upper end of said second vertical strut to said hull.

5. The hydrofoil assembly mounted on a hull, having a fore and aft centerline, of claim 1 further including:

(a) a hull, having bottom;

(b) a recess in the bottom of said hull;

(c) a hull attachment means for mounting the upper end of said vertical strut to the bottom of said hull;

(d) a retraction means for said hull attachment means to allow said vertical strut and said sloped hydrofoil to be retracted into said recess in the bottom of said hull.

6. The hydrofoil assembly mounted on a hull, having a fore and aft centerline, of claim 1 further including:

(a) a hull, having a bottom;

(b) a first hull attachment means for mounting the upper end of said vertical strut to the bottom of said hull;

(c) a second substantially vertical strut, having a bottom end, an upper end, and a rearward edge;

(d) a second sloped hydrofoil, having a bottom wingtip and an upper wingtip;

(e) a second hydrofoil hinging means, having a hinging axis, joining said second vertical strut to said second sloped hydrofoil, the hinging axis of said second hinging means substantially parallel to the fore and aft centerline of said hull;

(f) said second sloped hydrofoil located with the bottom wingtip of said second sloped hydrofoil lower than the hinging axis of said second hinging means, and the upper wingtip of said second sloped hydrofoil higher than the hinging axis of said second hinging means;

(g) said second hinging means, having a range of hinging motion, so that the upper wingtip of said second sloped hydrofoil remains above the hinging axis of said second hinging means for all range of hinging motion, and the bottom wingtip of said second sloped hydrofoil remains lower than the hinging axis of said hinging means for all range of hinging motion.

7. The hydrofoil assembly mounted on a hull, having a fore and aft centerline, of claim 1 further including:

(a) said sloped hydrofoil having a forward edge, an angle to the water flow and hydrodynamic forces;

(b) a flexible elastic hinging means, having a centerline, between said hydrofoil hinging means and said sloped hydrofoil, with the centerline of said flexible elastic hinging means substantially parallel to the forward edge of said sloped hydrofoil whereby said sloped hydrofoil reduces its angle to the water flow as the hydrodynamic forces of said sloped hydrofoil increase.

8. The hydrofoil assembly mounted on a hull, having a fore and aft centerline, of claim 1 further including:

(a) said sloped hydrofoil, having a forward edge, as rearward edge, an angle to the water flow, and hydrodynamic forces;

(b) a flexible elastic hinging means, having a hinging axis, between the forward edge of said sloped hydrofoil and the rearward edge of said sloped hydrofoil, with the hinging axis of said flexible hinging means substantially parallel to the forward edge of said sloped hydrofoil whereby the angle to the water flow of said sloped hydrofoil rearward edge is reduced as the hydrodynamic forces of said sloped hydrofoil increase.

9. The hydrofoil assembly mounted on a hull, having a fore and aft centerline, of claim 1 further including:

(a) said sloped hydrofoil, having an angle to the water flow;

(b) a hull attachment means for mounting the upper end of said vertical strut to the bottom of said hull;

(c) an adjustable pivoting means, having a hinging axis, for said hull attachment means to pivot said vertical strut, with the pivoting axis of said adjustable pivoting means substantially horizontally perpendicular to the fore and aft centerline of said hull whereby the angle to the water flow of said sloped hydrofoil is changed.

10. The hydrofoil assembly mounted on a hull, having a fore and aft centerline, of claim 1 further including a plurality of fibers, having an origin and an endpoint, in a composite laminate that comprises said vertical strut, the origin of said fibers at the upper end of said vertical strut, said fibers continue downward to the bottom end of said vertical strut, and fold around the bottom end of said vertical strut, and continue upward to the upper end of said vertical strut with said fibers endpoint at the upper end of said vertical strut adjacent to the origin of said fibers.

11. A hydrofoil assembly mounted on a hull, having a fore and aft centerline, comprising:

(a) a substantially vertical strut, having a bottom end, an upper end, and a rearward edge;

(b) a sloped hydrofoil, having a bottom wingtip and an upper wingtip;

(c) a hinge joint, having a hinging axis, joining said vertical strut to said sloped hydrofoil, the hinging axis of said hinge joint substantially parallel to the fore and aft centerline of said hull;

(d) said sloped hydrofoil located with the bottom wingtip of said sloped hydrofoil lower than the hinging axis of said hinge joint, and the upper wingtip of said sloped hydrofoil higher than the hinging axis of said hinge joint;

(e) said hinge joint, having a range of hinging motion, so that the upper wingtip of said sloped hydrofoil remains above the hinging axis of said hinge joint for all range of hinging motion, and the bottom wingtip of said sloped hydrofoil remains lower than the hinging axis of said hinge joint for all range of hinging motion.

12. The hydrofoil assembly mounted on a hull, having a fore and aft centerline, of claim 11 further including the upper wingtip of said sloped hydrofoil located completely rearward of the rearward edge of said vertical strut for all range of hinging motion.

13. The hydrofoil assembly mounted on a hull, having a fore and aft centerline, of claim 11 further including:

(a) a hull in contact with the water, having a bottom;

(b) a hull attachment joint for mounting the upper end of said vertical strut to the bottom of said hull.

14. The hydrofoil assembly mounted on a hull, having a fore and aft centerline, of claim 11 further including:

(a) a hull, having a bottom;

(b) a first hull attachment joint for mounting the upper end of said vertical strut to the bottom of said hull;

(c) a second substantially vertical strut, having an upper end;

(d) a second hull attachment joint for mounting the upper end of said second vertical strut to said hull.

15. The hydrofoil assembly mounted on a hull, having a fore and aft centerline, of claim 11 further including:

(a) a hull, having bottom;

(b) a recess in the bottom of said hull;

(c) a hull attachment joint for mounting the upper end of said vertical strut to the bottom of said hull;

(d) a retraction mechanism for said hull attachment joint to allow said vertical strut and said sloped hydrofoil to be retracted into said recess in the bottom of said hull.

16. The hydrofoil assembly mounted on a hull, having a fore and aft centerline, of claim 11 further including:

(a) a hull, having a bottom;

(b) a first hull attachment joint for mounting the upper end of said vertical strut to the bottom of said hull;

(c) a second substantially vertical strut, having a bottom end, an upper end, and a rearward edge;

(d) a second sloped hydrofoil, having a bottom wingtip and an upper wingtip;

(e) a second hydrofoil hinge joint, having a hinging axis, joining said second vertical strut to said second sloped hydrofoil, the hinging axis of said second hinge substantially parallel to the fore and aft centerline of said hull;

(f) said second sloped hydrofoil located with the bottom wingtip of said second sloped hydrofoil lower than the hinging axis of said second hinge joint, and the upper wingtip of said second sloped hydrofoil higher than the hinging axis of said second hinge joint;

(g) said second hinge joint, having a range of hinging motion, so that the upper wingtip of said second sloped hydrofoil remains above the hinging axis of said second hinge joint for all range of hinging motion, and the bottom wingtip of said second sloped hydrofoil remains lower than the hinging axis of said hinge joint for all range of hinging motion.

17. The hydrofoil assembly mounted on a hull, having a fore and aft centerline, of claim 11 further including:

(a) said sloped hydrofoil having a forward edge, an angle to the water flow and hydrodynamic forces;

(b) a flexible elastic hinge, having a centerline, between said hydrofoil hinge joint and said sloped hydrofoil, with the centerline of said flexible elastic hinge substantially parallel to the forward edge of said sloped hydrofoil whereby said sloped hydrofoil reduces its angle to the water flow as the hydrodynamic forces of said sloped hydrofoil increase.

18. The hydrofoil assembly mounted on a hull, having a fore and aft centerline, of claim 11 further including:

(a) said sloped hydrofoil, having a forward edge, as rearward edge, an angle to the water flow, and hydrodynamic forces;

(b) a flexible elastic hinge, having a hinging axis, between the forward edge of said sloped hydrofoil and the rearward edge of said sloped hydrofoil, with the hinging axis of said flexible hinge substantially parallel to the forward edge of said sloped hydrofoil whereby the angle to the water flow of said sloped hydrofoil rearward edge is reduced as the hydrodynamic forces of said sloped hydrofoil increase.

19. The hydrofoil assembly mounted on a hull, having a fore and aft centerline, of claim 11 further including:

(a) said sloped hydrofoil, having an angle to the water flow;

(b) a hull attachment joint for mounting the upper end of said vertical strut to the bottom of said hull;

(c) an adjustable pivoting mechanism, having a hinging axis, for said hull attachment joint to pivot said vertical strut, with the pivoting axis of said adjustable pivoting mechanism substantially horizontally perpendicular to the fore and aft centerline of said hull whereby the angle to the water flow of said sloped hydrofoil is changed.

20. The hydrofoil assembly mounted on a hull, having a fore and aft centerline, of claim 11 further including a plurality of fibers, having an origin and an endpoint, in a composite laminate that comprises said vertical strut, the origin of said fibers at the upper end of said vertical strut, said fibers continue downward to the bottom end of said vertical strut, and fold around the bottom end of said vertical strut, and continue upward to the upper end of said vertical strut with said fibers endpoint at the upper end of said vertical strut adjacent to the origin of said fibers.

* * * * *